US008282230B2

(12) United States Patent
Stewart et al.

(10) Patent No.: US 8,282,230 B2
(45) Date of Patent: Oct. 9, 2012

(54) LIQUID DISPLACEMENT BEADS IN LED BULBS

(75) Inventors: Ray F. Stewart, Belmont, CA (US); Brett Sharenow, San Mateo, CA (US); David Horn, Saratoga, CA (US)

(73) Assignee: Switch Bulb Company, Inc., San Jose, CA (US)

( * ) Notice: Subject to any disclaimer, the term of this patent is extended or adjusted under 35 U.S.C. 154(b) by 0 days.

(21) Appl. No.: 13/070,309

(22) Filed: Mar. 23, 2011

(65) Prior Publication Data

US 2011/0228516 A1 Sep. 22, 2011

(51) Int. Cl.
*F21V 33/00* (2006.01)

(52) U.S. Cl. ..... 362/101; 362/373; 362/294

(58) Field of Classification Search ..... 362/373, 362/294, 311.02, 311.11, 263, 101
See application file for complete search history.

(56) References Cited

U.S. PATENT DOCUMENTS

| | | | | |
|---|---|---|---|---|
| 2,980,547 | A | 4/1961 | Duval d'Adrian | |
| 3,293,051 | A | 12/1966 | Searight et al. | |
| 3,330,961 | A | 7/1967 | Aia | |
| 3,560,074 | A | 2/1971 | Searight et al. | |
| 4,170,035 | A * | 10/1979 | Walker | 362/96 |
| 4,675,575 | A | 6/1987 | Smith et al. | |
| 6,059,676 | A * | 5/2000 | Seymour et al. | 473/570 |
| 2003/0196357 | A1 * | 10/2003 | Knapp et al. | 40/410 |
| 2006/0274797 | A1 * | 12/2006 | Myers et al. | 372/35 |
| 2007/0291482 | A1 * | 12/2007 | Baroky et al. | 362/227 |
| 2008/0013316 | A1 * | 1/2008 | Chiang | 362/264 |
| 2008/0219007 | A1 * | 9/2008 | Heffington et al. | 362/294 |
| 2009/0001372 | A1 * | 1/2009 | Arik et al. | 257/58 |
| 2009/0001390 | A1 * | 1/2009 | Yan et al. | 257/89 |
| 2010/0170670 | A1 * | 7/2010 | Catalano | 165/185 |
| 2011/0267805 | A1 * | 11/2011 | Hua et al. | 362/101 |

OTHER PUBLICATIONS

International Search Report and Written Opinion received for PCT Patent Application No. PCT/US2012/030177, mailed on Jul. 11, 2012, 9 pages.

Potter Industries Inc., "Material Safety Data Sheet (MSDS) for Sphencel Brand Hollow Glass Spheres" retrieved from Internet on Jun. 22, 2012, 4 pages available at : <URL: http//www.google.com/search!q=sphericel+msds&ie=utf-8&oe=utf-8&aq=t&r1s=org.rnozilla: en-US. official&clienl=firefox-attnl=en&gs_nf=1&gs_mss=sphericel%20&pq=sphericel20msds&cp=17&gs_id=by&xhr=t&q=sphericel+hollow+glass+sphe res&pf=p&c1ient=firefox-a&hs=7HC&rfs=org.mozllia:e n-US%3Aofficial&sclient=psy-http://pottersbeads,com/egm/NorthAmerica/Products/HollowInorganicMicrospheres.aspx.

Solids and Metals-Specific Gravities, "Specific Gravity for Some Common Solids and Metals as Aluminum, Asbestos.Brass, Calcium and Many Others" retrieved from Internet on Jun. 22, 2012, 10 pages, available at: <URL:http://www.engineeringtoolbox.com/specific-gravity-solids-metals-<C293.html>.

(Continued)

*Primary Examiner* — Julie Shallenberger
(74) *Attorney, Agent, or Firm* — Morrison & Foerster LLP

(57) ABSTRACT

An LED bulb includes at least one LED mount disposed within a shell. At least one LED is attached to the at least one LED mount. A thermally conductive liquid is held within the shell. The LED and LED mount are immersed in the thermally conductive liquid. A plurality of beads is suspended in the thermally conductive liquid. The plurality of beads is configured to displace a predetermined amount of the thermally conductive liquid to reduce the amount of thermally conductive liquid held within the shell.

20 Claims, 6 Drawing Sheets

OTHER PUBLICATIONS

Specific Gravity-Liquids, "Specific Gravity ot Some Common Liquids and Fluids as Alcohol, Oils, Benzene. Water and Many More" retrieved from Internet on Jun. 22, 2012, 6 pages, available at: <URL: http//www.engineeringtoolbox.com/specific-gravity-liquids-d_336.html>.

* cited by examiner

LIQUID DISPLACEMENT BEADS IN LED BULBS

BACKGROUND

1. Field

The present disclosure relates generally to liquid-filled light-emitting-diode (LED) bulbs, and more specifically to a plurality of beads in liquid-filled LED bulbs.

2. Related Art

Traditionally, lighting has been generated using fluorescent and incandescent light bulbs. While both types of light bulbs have been reliably used, each suffers from certain drawbacks. For instance, incandescent bulbs tend to be inefficient, using only 2-3% of their power to produce light, while the remaining 97-98% of their power is lost as heat. Fluorescent bulbs, while more efficient than incandescent bulbs, do not produce the same warm light as that generated by incandescent bulbs. Additionally, there are health and environmental concerns regarding the mercury contained in fluorescent bulbs.

Thus, an alternative light source is desired. One such alternative is a bulb utilizing an LED. An LED comprises a semiconductor junction that emits light due to an electrical current flowing through the junction. Compared to a traditional incandescent bulb, an LED bulb is capable of producing more light using the same amount of power. Additionally, the operational life of an LED bulb is orders of magnitude longer than that of an incandescent bulb, for example, 10,000-100,000 hours as opposed to 1,000-2,000 hours.

While there are many advantages to using an LED bulb rather than an incandescent or fluorescent bulb, LEDs have a number of drawbacks that have prevented them from being as widely adopted as incandescent and fluorescent replacements. One drawback is that an LED, being a semiconductor, generally cannot be allowed to get hotter than approximately 120° C. As an example, A-type LED bulbs have been limited to very low power (i.e., less than approximately 8 W), producing insufficient illumination for incandescent or fluorescent replacements.

One approach to alleviating the heat problem of LED bulbs is to fill an LED bulb with a thermally conductive liquid, to transfer heat from the LEDs to the bulb's shell. The heat may then be transferred from the shell out into the air surrounding the bulb. The thermally conductive liquid, however, contributes to the LED bulb's weight. Also, as heat is transferred from the LED to the conductive liquid, the temperature of the liquid increases, resulting in an increase in the liquid volume due to thermal expansion.

BRIEF SUMMARY

In one exemplary embodiment, an LED bulb includes at least one LED mount disposed within a shell. At least one LED is attached to the at least one LED mount. A thermally conductive liquid is held within the shell. The LED and LED mount are immersed in the thermally conductive liquid. A plurality of beads is suspended in the thermally conductive liquid. The plurality of beads is configured to displace a predetermined amount of the thermally conductive liquid to reduce the amount of thermally conductive liquid held within the shell.

BRIEF DESCRIPTION OF THE DRAWINGS

The present application can be best understood by reference to the following description taken in conjunction with the accompanying drawing figures, in which like parts may be referred to by like numerals.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various embodiments. Thus, the various embodiments are not intended to be limited to the examples described herein and shown, but are to be accorded the scope consistent with the claims.

Various embodiments are described below relating to LED bulbs. As used herein, an "LED bulb" refers to any light-generating device (e.g., a lamp) in which at least one LED is used to generate light. Thus, as used herein, an "LED bulb" does not include a light-generating device in which a filament is used to generate the light, such as a conventional incandescent light bulb. It should be recognized that the LED bulb may have various shapes in addition to the bulb-like A-type shape of a conventional incandescent light bulb. For example, the bulb may have a tubular shape, a globe shape, or the like. The LED bulb of the present disclosure may further include any type of connector; for example, a screw-in base, a dual-prong connector, a standard two- or three-prong wall outlet plug, bayonet base, Edison Screw base, single-pin base, multiple-pin base, recessed base, flanged base, grooved base, side base, or the like.

As used herein, the term "liquid" refers to a substance capable of flowing. Also, the substance used as the thermally conductive liquid is a liquid or at the liquid state within, at least, the operating ambient temperature range of the bulb. An exemplary temperature range includes temperatures between −40° C. to +40° C. Also, as used herein, "passive convective flow" refers to the circulation of a liquid without the aid of a fan or other mechanical devices driving the flow of the thermally conductive liquid.

Figure 1:
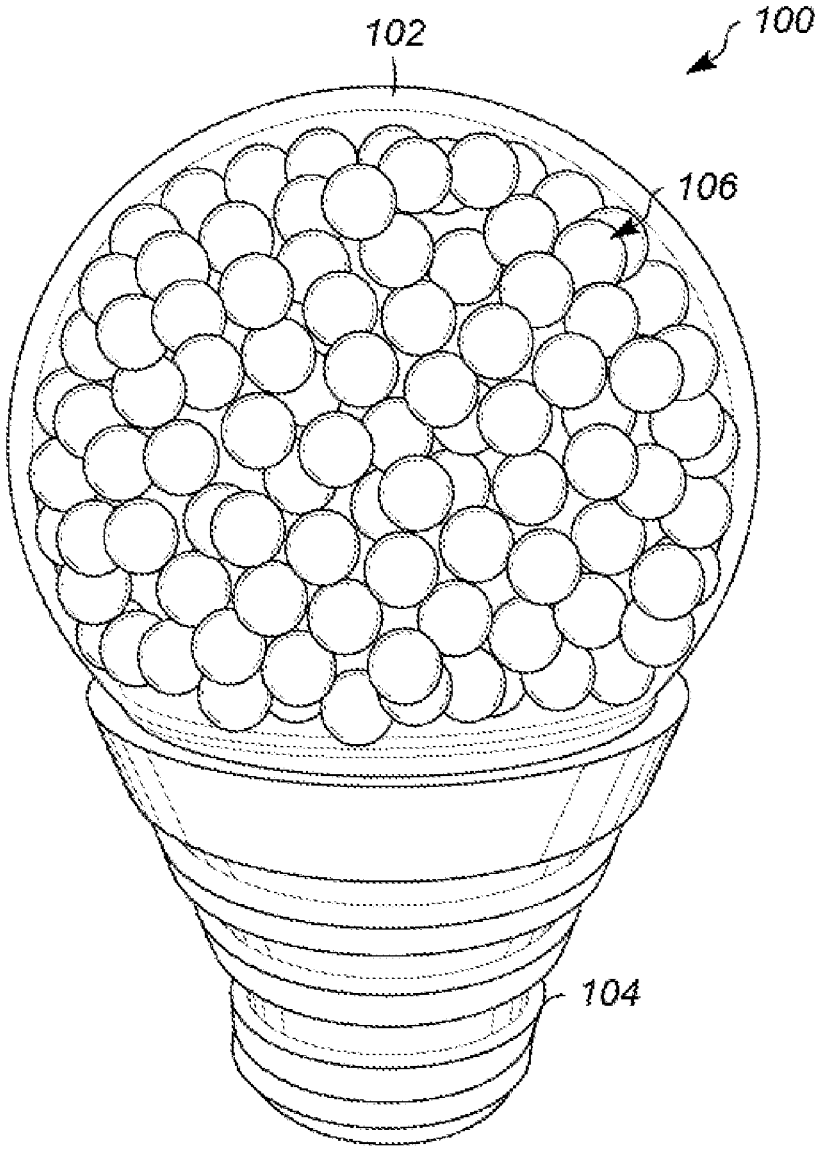
FIG. 1 depicts a plurality of beads disposed with an exemplary LED bulb.

FIG. 1 depicts an exemplary LED bulb 100. LED bulb 100 includes a shell 102 and base 104. An enclosed volume is defined within shell 102, which is filled with a thermally conductive liquid.

As can be seen in FIG. 1, in the present exemplary embodiment, a plurality of beads 106 is disposed within shell 102 to reduce the amount of thermally conductive liquid held within shell 102 (more precisely, the enclosed volume defined within shell 102). The plurality of beads 106 is also configured to permit a passive convective flow of the thermally conductive liquid to exist within shell 102.

Figure 2:
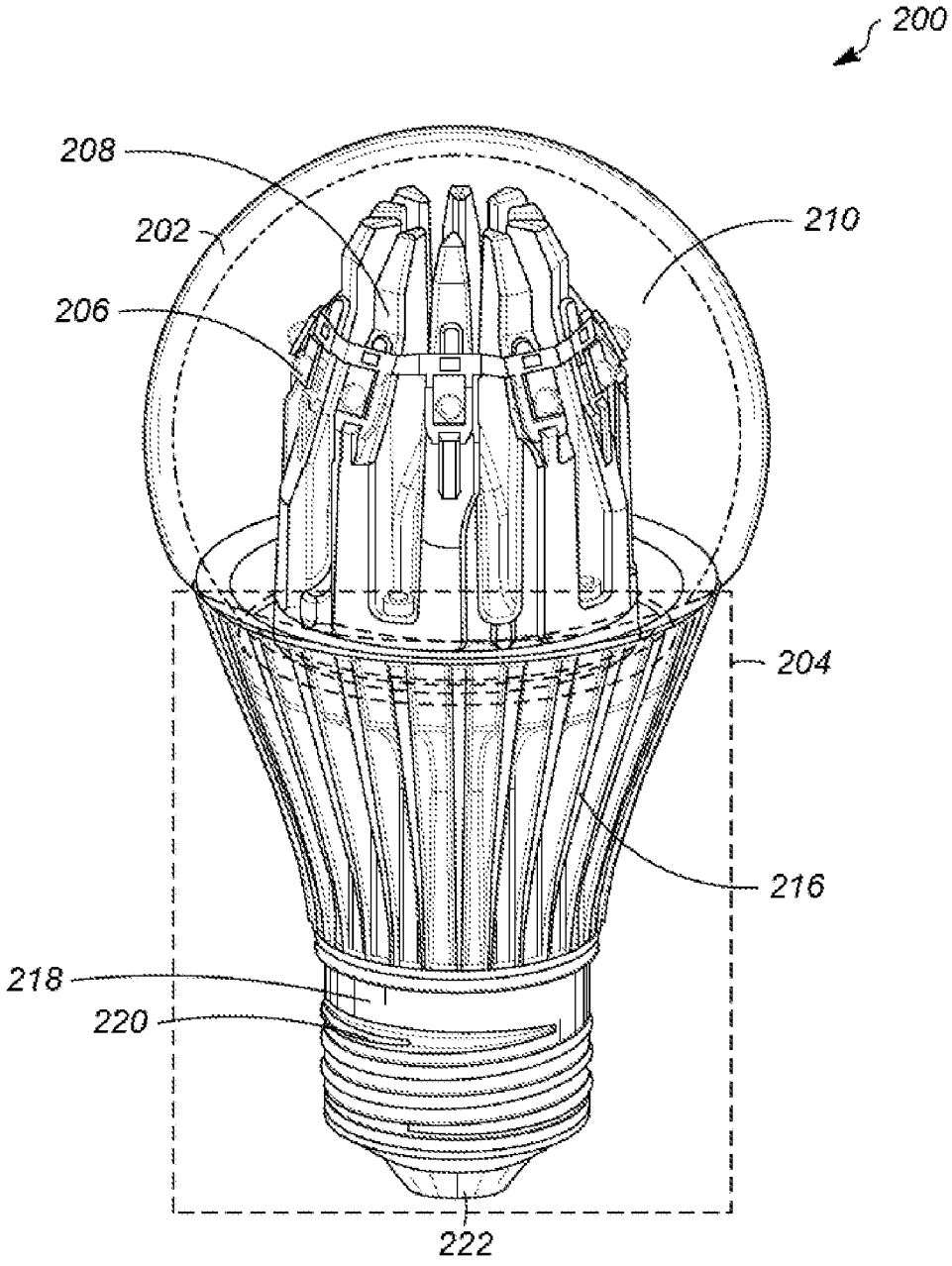
FIG. 2 depicts an exemplary LED bulb without the plurality beads depicted.

FIG. 2 depicts an exemplary LED bulb 200. However, LED bulb 200 is depicted without the plurality of beads disposed within shell 202 in order to show the structures obscured by the plurality of beads in FIG. 1.

Similar to LED bulb 100 (FIG. 1), LED bulb 200 includes a shell 202 and base 204 forming an enclosed volume over one or more LEDs 206. Shell 202 may be made from any transparent or translucent material such as plastic, glass, polycarbonate, or the like. Shell 202 may include dispersion material spread throughout the shell to disperse light generated by LEDs 206. The dispersion material prevents LED bulb 200 from appearing to have one or more point sources of light.

In some embodiments, LED bulb 200 may use 6 W or more of electrical power to produce light equivalent to a 40 W incandescent bulb. In some embodiments, LED bulb 200 may use 20 W or more to produce light equivalent to or greater than a 75 W incandescent bulb. Depending on the efficiency of the LED bulb 200, between 4 W and 16 W of heat energy may be produced when the LED bulb 200 is illuminated.

For convenience, all examples provided in the present disclosure describe and show LED bulb 200 being a standard A-type form factor bulb. However, as mentioned above, it should be appreciated that the present disclosure may be applied to LED bulbs having any shape, such as a tubular bulb, a globe-shaped bulb, or the like.

As shown in FIG. 2, LEDs 206 are attached to LED mounts 208. LED mounts 208 may be made of any thermally conductive material, such as aluminum, copper, brass, magnesium, zinc, or the like. Since LED mounts 208 are formed of a thermally conductive material, heat generated by LEDs 206 may be conductively transferred to LED mounts 208. Thus, LED mounts 208 may act as a heat-sink or heat-spreader for LEDs 206.

LED bulb 200 is filled with thermally conductive liquid 210 for transferring heat generated by LEDs 206 to shell 202. The thermally conductive liquid 210 may be mineral oil, silicone oil, glycols (PAGs), fluorocarbons, or other material capable of flowing. It may be desirable to have the liquid chosen be a non-corrosive dielectric. Selecting such a liquid can reduce the likelihood that the liquid will cause electrical shorts and reduce damage done to the components of LED bulb 200. Also, it may be desirable for thermally conductive liquid 210 to have a large coefficient of thermal expansion to facilitate passive convective flow.

Figure 3A:
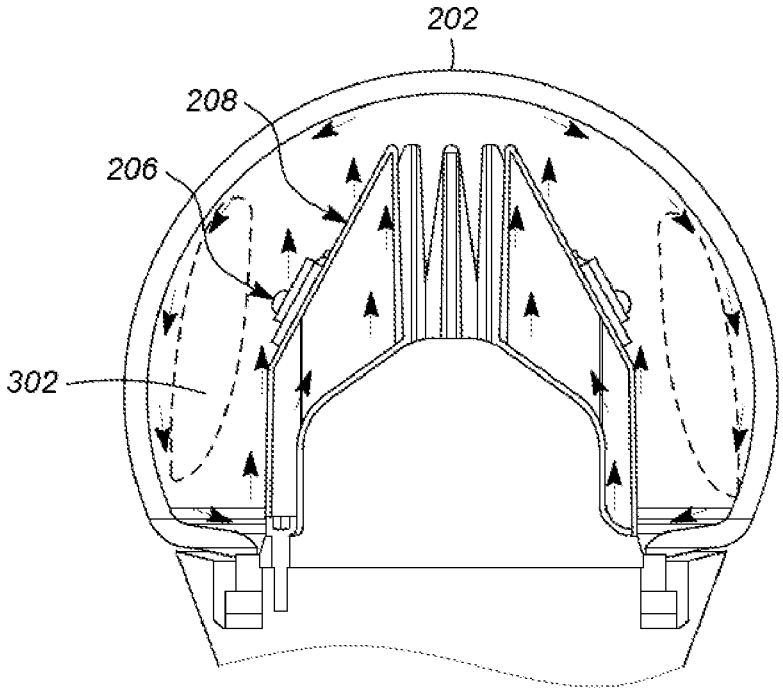
FIGS. 3A-3C depict passive convective flow within an exemplary LED bulb positioned upright, sideways, and upside down, respectively.
Figure 3B:
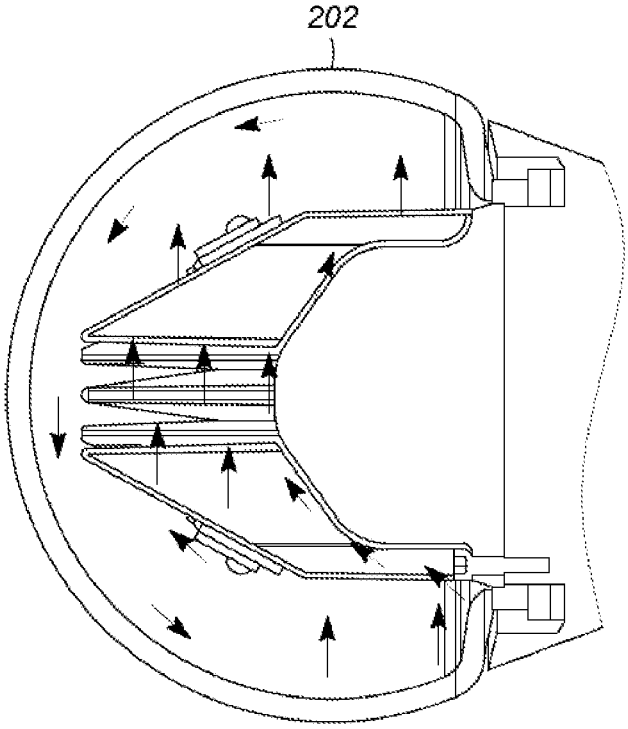
Figure 3C:
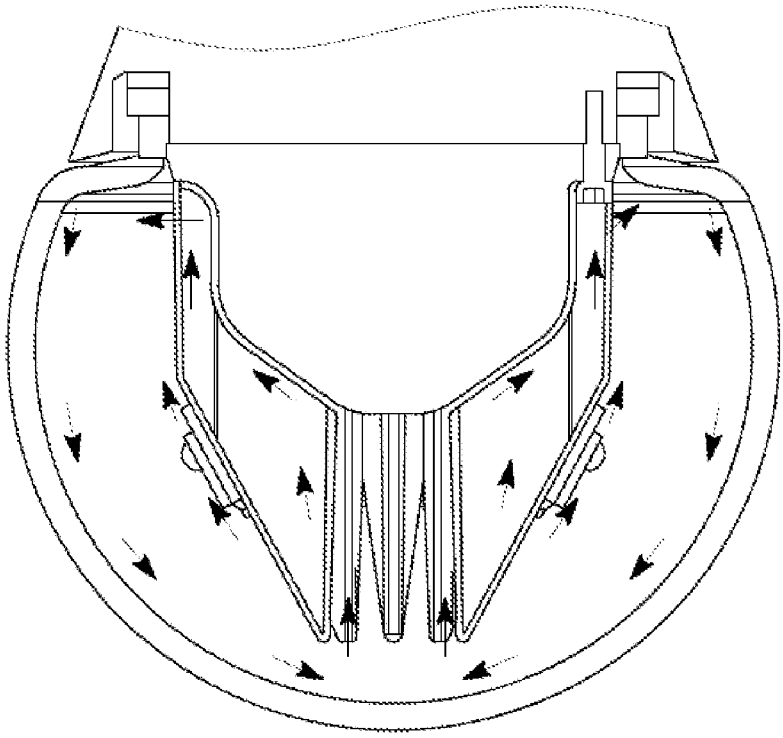

As depicted by the arrows in FIGS. 3A-3C, heat is transferred away from LEDs 206 in LED bulb 200 via passive convective flows. In particular, cells of liquid surrounding LEDs 206 absorb heat, become less dense due to the temperature increase, and rise upwards. Once the cells of liquid discharge the heat at the top and cool down, they become denser and descend to the bottom.

As also depicted by the arrows in FIGS. 3A-3C, the motion of the cells of liquid may be further distinguished by zones with cells of liquid that are moving in the same direction, and dead zones 302, i.e., zones between cells of liquid that are moving in opposite directions. Within a dead zone 302, the shear force between cells of liquid moving in one direction and cells of liquid moving in the opposite direction slows the convective flow of liquid within the dead zone 302, such that liquid in dead zones 302 may not significantly participate in the convective flow nor efficiently carry heat away from the LEDs 206. Thermally conductive liquid in dead zones 302, however, contributes to the LED bulb's overall weight. Additionally, the thermal expansion of the thermally conductive liquid within the dead zones 302, as the LED bulb's temperature increases from room temperature (e.g., between 20-30 Celsius) to an operating temperature (e.g., between 70-90 Celsius), should be accommodated.

With reference again to FIG. 1, as discussed above, the plurality of beads 106 is configured to displace a predetermined amount of the thermally conductive liquid, which reduces the amount of the thermally conductive liquid held within the shell of the LED bulb. In the present exemplary embodiment, the plurality of beads 106 is depicted as being distributed throughout the thermally conductive liquid. The beads 106 are suspended in the thermally conductive liquid without being attached to other components or structures. The passive convective flow of the thermally conductive liquid flows along the paths defined by the space between the plurality of beads 106. In this manner, the LEDs can be cooled using a smaller volume of the thermally conductive liquid. Reducing the amount of thermally conductive liquid has the advantage of reducing the overall weight of the LED bulb. Also, reducing the amount of the thermally conductive liquid reduces the amount of volume that will need to be compensated for when the thermally conductive liquid expands in operation.

The beads 106 may be spherical in shape. The beads 106 may have dimensions that are smaller than the opening of the shell 102, such that the beads 106 may be readily inserted into the LED bulb. For example, the beads 106 may have dimensions ranging from 1 mm to 5 mm. However, those skilled in the art will recognize that beads in other shapes and sizes may be used as well. In some exemplary embodiments, the plurality of beads 106 may be monodisperse, i.e., they have the same size and shape. In some exemplary embodiments, the plurality of beads 106 may have different sizes and shapes.

The plurality of beads 106 may be made of rigid materials, such as plastic or glass, or they may be made of compressible materials. Beads 106 that are constructed of a glass material have a smaller coefficient of thermal expansion than the thermally conductive liquid, thereby mitigating the volume expansion problem. The plurality of beads 106 may be formed of a thermally conductive material, thereby facilitating the transfer of heat from the LEDs to the shell 102 and the air surrounding the LED bulb. The beads 106 are also preferably made of a material that is inert towards the thermally conductive liquid being used.

The beads 106 may have a lower specific gravity than the thermally conductive liquid, thereby reducing the overall weight of the LED bulb. However, the beads 106 may have approximately the same or higher specific gravity than the thermally conductive liquid. Although the overall weight of the LED bulb is not reduced, the beads 106 do reduce the amount of thermally conductive liquid needed, which does, as an example, mitigate the volume expansion problem.

The beads 106 may be transparent, translucent, or reflective. The beads 106 may be colored or coated with material to change the spectrum of the light output of the LED bulb. For example, the beads 106 may include one or more phosphor particles.

Beads 106 may perform a light-scattering function. For example, the beads 106 may contain scattering particles with a high index of refraction; for example, titanium dioxide, which has an index of refraction exceeding 2.0, may be used. Alternatively, the scattering particles may be suspended in the thermally conductive liquid; however, this may limit the thermally conductive liquid to polar liquids only, as non-polar liquids often do not suspend particles well. To the extent that the beads 106 can perform the light-scattering function, the choice of thermally conductive liquid will no longer be restricted to polar liquids, thereby allowing the use of thermally conductive liquids that are more inert, or have a large coefficient of thermal expansion to facilitate passive convective flow.

Additionally, the index of refraction of the beads 106 and the index of refraction of the thermally conductive liquid can be selected to control the amount of diffusion and optical loss. For example, the beads 106 may be made of a material with an index of refraction approximately the same as that of the thermally conductive liquid to minimize diffusion and optical loss. Thus, when index of refraction of the beads 106 and the index of refraction of the thermally conductive liquid are approximately the same, any change in the light traveling through the beads 106 and the thermally conductive liquid may be imperceptible to a human, and thus making the beads 106 appear invisible within the thermally conductive liquid. By increasing the difference between the index of refraction of the beads 106 and the index of refraction of the thermally conductive liquid, the scattering and optical loss can be increased. For example, the index of refraction of the beads 106 can be at least 0.05 greater or less than the index of refraction of the thermally conductive liquid.

Beads 106 may further function as liquid volume compensators to compensate for the volume expansion of the thermally conductive liquid as the temperature rises. For example, the plurality of beads 106 may be made of an elastomeric polymer foam containing microscopic air bubbles that do not leak out upon compression. As the thermally conductive liquid heats and expands, the beads 106 may be compressed, since its air bubbles are compressible. The air bubbles may have a dimension close to the wavelength of light, such that the air bubbles may serve as the light-diffusing particles and no additional diffusing materials (e.g., titanium dioxide) may be required.

Figure 4A:
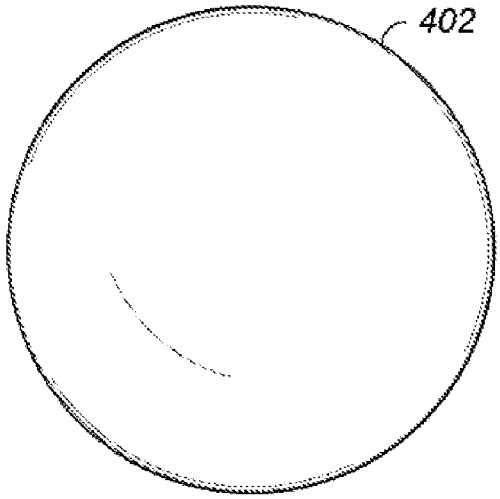
FIG. 4A depicts an exemplary solid bead.
Figure 4B:
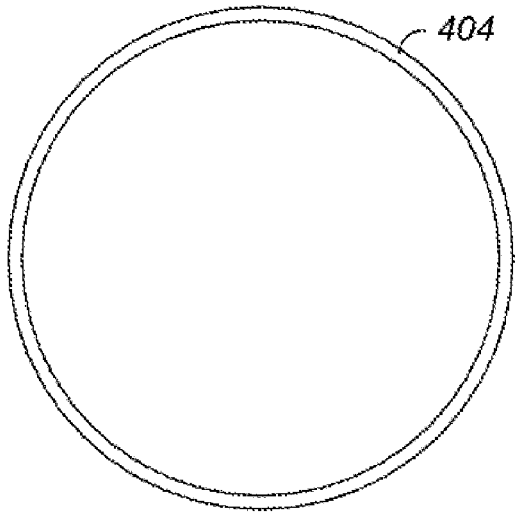
FIG. 4B depicts an exemplary hollow bead.

As depicted FIGS. 4A and 4B, the plurality of beads 106 may be solid beads 402 or hollow beads 404, respectively. Solid beads 402 may transfer more heat away from the LEDs if the beads have a higher thermal conductivity compared to air or the thermally conductive liquid. On the other hand, hollow beads 404 may displace a larger volume of the thermally conductive liquid with less material, which may translate to a lower cost and a lower weight for the LED bulb.

Figure 4C:
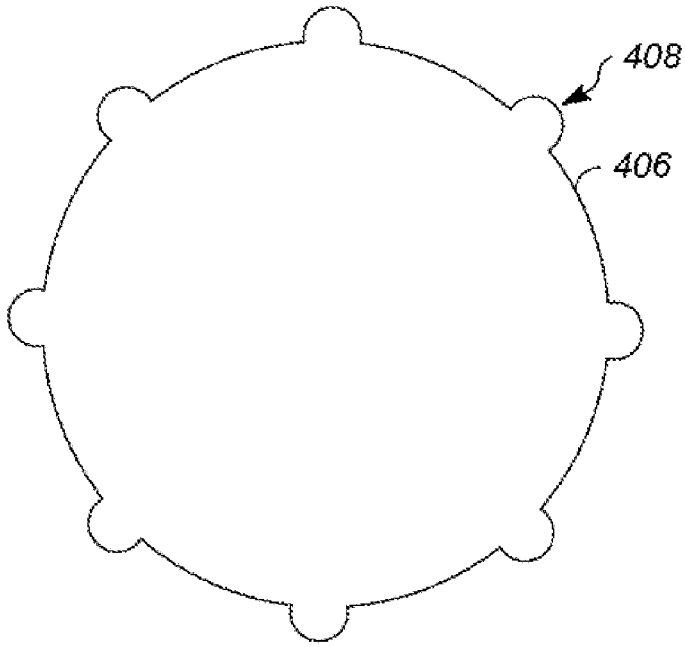
FIG. 4C depicts another exemplary bead.
Figure 5:
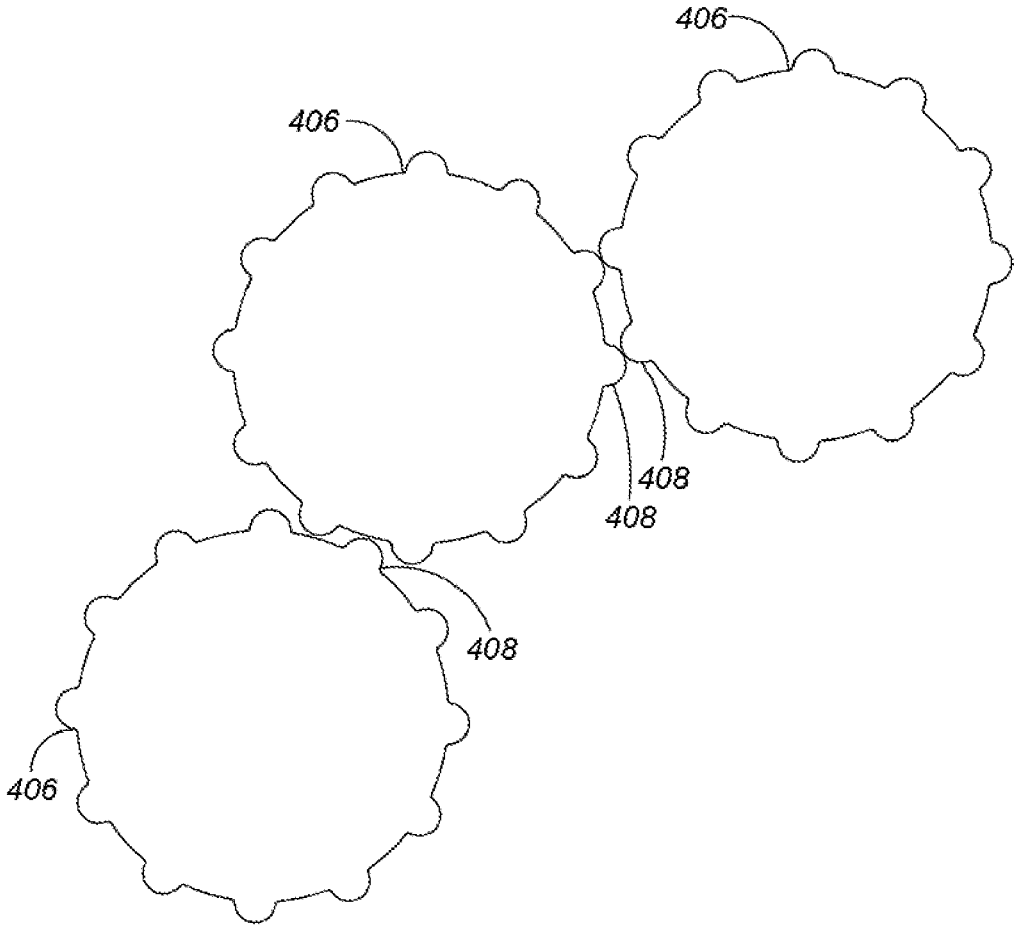
FIG. 5 depicts a plurality of exemplary beads adjacent to each other.

FIG. 4C depicts yet another exemplary plurality of beads 406. The plurality of beads 406 has a plurality of nibs 408, i.e., small pointed or projecting parts, located on its surface. As shown in FIG. 5, if a nib 408 on a bead 406 touches a nib 408 on another bead 406, then the two beads 406 may be spaced further apart, providing additional flow paths for the thermally conductive liquid to migrate from the LED heat sources to the shell. If a nib 408 on a bead 406 touches the flat surface of another bead 406, then the two beads 406 may be spaced closer together, displacing more liquid and reducing the overall weight of the LED bulb. With reference again to FIG. 4C, the nibs 408 may minimize the surface contact between the beads 406 and other components of the LED bulb, including the LEDs, the shell, the LED mounts, and the like. It should be recognized that the beads 406 with the plurality of nibs 408 may be solid or hollow and have various shapes and sizes.

With reference again to FIG. 2, LED bulb 200 may include a connector base 218. The connector base 218 may be configured to fit within and make electrical contact with an electrical socket. The electrical socket may be dimensioned to receive an incandescent, CFL, or other standard light bulb as known in the art. In one exemplary embodiment, the connector base 218 may be a screw-in base including a series of screw threads 220 and a base pin 222. The screw-in base makes electrical contact with the AC power through its screw threads 220 and its base pin 222. However, it should be recognized that the connector base 218 may be any type of connector.

LED bulb 200 may include a heat-spreader base 216. The heat-spreader base 216 may be thermally coupled to one or more of the shell 202, LED mount 208, and the thermally conductive liquid 210, so as to conduct heat generated by the LEDs to the heat-spreader base 216 to be dissipated. The heat-spreader base 216 may be made from any thermally conductive material, such as aluminum, copper, brass, magnesium, zinc, or the like.

Although only certain exemplary embodiments have been described in detail above, those skilled in the art will readily appreciate that many modifications are possible in the exemplary embodiments without materially departing from the novel teachings and advantages of this invention. For example, aspects of embodiments disclosed above can be combined in other combinations to form additional embodiments. Accordingly, all such modifications are intended to be included within the scope of this invention.

What is claimed is:

1. A light-emitting-diode (LED) bulb comprising:
a base;
a shell connected to the base;
at least one LED mount disposed within the base;
at least one LED attached to the at least one LED mount;
a thermally conductive liquid held within the shell, wherein the LED and the LED mount are immersed in the thermally conductive liquid; and
a plurality of beads suspended in the thermally conductive liquid, wherein the plurality of beads is configured to displace a predetermined amount of the thermally conductive liquid to reduce the amount of thermally conductive liquid held within the shell, and wherein the plurality of beads is transparent or translucent.

2. The LED bulb of claim 1, wherein the plurality of beads is configured to allow a passive convective flow of the thermally conductive liquid from the LED mount to an inner surface of the shell through the space between the plurality of the beads.

3. The LED bulb of claim 1, wherein the beads are spherical in shape.

4. The LED bulb of claim 1, wherein the beads are sized to fit through an opening of the shell.

5. The LED bulb of claim 1, wherein the beads are reflective.

6. The LED bulb of claim 1, wherein the beads are colored or coated with material to change the spectrum of the light output of the LED bulb.

7. The LED bulb of claim 1, wherein the beads are solid.

8. The LED bulb of claim 1, wherein the beads are hollow.

9. The LED bulb of claim 1, wherein the beads have nibs on the surfaces of the beads.

10. The LED bulb of claim 1, wherein the beads contain a scattering agent to diffuse light.

11. The LED bulb of claim 1, wherein the beads are compressible, and wherein the beads are compressed in response to expansion of the thermally conductive liquid.

12. The LED bulb of claim 11, wherein the plurality have air bubbles, which do not leak out upon compression.

13. The LED bulb of claim 1, wherein the beads are formed of a material with an index of refraction approximately the same as that of the thermally conductive liquid.

14. The LED bulb of claim 1, wherein the beads are formed of a material with an index of refraction at least 0.05 greater than or less than that of the thermally conductive liquid.

15. The LED bulb of claim 1, wherein the beads have a specific density approximately the same as the thermally conductive liquid.

16. The LED bulb of claim 1, wherein the beads have a specific density greater or less than that of the thermally conductive liquid.

17. The LED bulb of claim 1, wherein the beads comprise one or more phosphor particles.

18. A light-emitting diode (LED) bulb comprising:

a base;

a shell connected to the base;

at least one LED mount disposed within the base;

at least one LED attached to the at least one LED mount;

a thermally conductive liquid held within the shell, wherein the LED and the LED mount are immersed in the thermally conductive liquid; and a plurality of beads suspended in the thermally conductive liquid, wherein the plurality of beads is configured to displace a predetermined amount of the thermally conductive liquid to reduce the amount of thermally conductive liquid held within the shell, and wherein the plurality of beads is transparent or translucent.

19. The LED bulb of claim 18, wherein the beads have nibs on the surfaces of the beads.

20. A method of making a light-emitting diode (LED) bulb having one or more LEDs, comprising:

filling a shell of the LED bulb with a thermally conductive liquid; and inserting a plurality of beads within the shell of the LED bulb, wherein the plurality of beads is configured to displace a predetermined amount of the thermally conductive liquid to reduce the amount of thermally conductive liquid held within the shell, and wherein the plurality of beads is transparent or translucent.

* * * * *

UNITED STATES PATENT AND TRADEMARK OFFICE

CERTIFICATE OF CORRECTION

PATENT NO. : 8,282,230 B2
APPLICATION NO. : 13/070309
DATED : October 9, 2012
INVENTOR(S) : Ray F. Stewart et al.

It is certified that error appears in the above-identified patent and that said Letters Patent is hereby corrected as shown below:

On the Title page, Item (56) under "OTHER PUBLICATIONS", in column 2, line 4-13, Delete:

> "Potter Industries Inc., "Material Safety Data Sheet (MSDS) for Sphencel Brand Hollow Glass Spheres" retrieved from Internet on Jun. 22, 2012, 4 pages available at: <URL: http//www.google.com/search!q=sphericel+msds&ie=utf-8&oe=utf-8&aq=t&r1s=o-rg.rnozilla: en-US. official&clienl=firefox-attnl=en&gs_nf=1&gs_mss=sphericel%20&-pq=spherice120msds&cp=l7&gs_id=by&xhr=t&q=sphericel+hollow+glass+sph- e res&pf=p&c1ie nt=firefox-a&hs=7HC&rfs=org.mozllia:e n-US%3Aofficial&sclient=psy-http://pottersbeads,com/egm/NorthAmerica/Products/HollowInorganicMicrospheres.aspx."

and insert:

> -- Potter Industries Inc., "Material Safety Data Sheet (MSDS) for Sphencel Brand Hollow Glass Spheres" retrieved from Internet on Jun. 22, 2012, 4 pages available at: <URL: http//www.google.com/search?q=sphericel+msds&ie=utf-8&oe=utf-8&aq=t&r1s=org.mozilla: en-US. official&client=firefox-a#h=en&gs_nf=1&gs_mss=sphericel%20&-pq=sphericel20msds&cp=17&gs_id=by&xhr=t&q=sphericel+hollow+glass+spheres&pf=p&cient=firefox-a&hs=7HC&rfs=org.mozilla:en-US%3Aofficial&client=psy-http://pottersbeads.com/egm/NorthAmerica/Products/HollowInorganicMicrospheres.aspx. --, therefor.

On Title page 2, Item (56) under "OTHER PUBLICATIONS", in column 1, line 1, Delete "ot" and insert -- of --, therefor.

Signed and Sealed this
Twenty-ninth Day of April, 2014

Michelle K. Lee

Michelle K. Lee
*Deputy Director of the United States Patent and Trademark Office*